United States Patent [19]

Barkley

[11] Patent Number: 4,796,543

[45] Date of Patent: Jan. 10, 1989

[54] CLOSURE ASSEMBLY FOR A FURNACE

[75] Inventor: James D. Barkley, Bethlehem, Pa.

[73] Assignee: Foster Wheeler Energy Corporation, Clinton, N.J.

[21] Appl. No.: 41,161

[22] Filed: Apr. 22, 1987

[51] Int. Cl.[4] ..... F23M 7/00

[52] U.S. Cl. ..... 110/173 R; 432/250

[58] Field of Search ..... 110/173 R, 173 B, 180, 110/181, 331, 332, 336, 338, 339; 122/497, 498; 432/250; 49/501; 202/242, 248

[56] References Cited

U.S. PATENT DOCUMENTS

| | | | |
|---|---|---|---|
| 3,204,939 | 9/1965 | Ipsen | 110/331 X |
| 3,505,174 | 4/1970 | Peterson et al. | 202/248 |
| 4,016,820 | 4/1977 | Johnson et al. | 110/173 R |
| 4,107,890 | 8/1978 | Seghezzi et al. | 110/336 X |
| 4,157,001 | 6/1979 | Pickles | 110/336 X |
| 4,406,619 | 9/1983 | Oldengott | 432/250 |

*Primary Examiner*—Steven E. Warner

*Attorney, Agent, or Firm*—Marvin A. Naigur; Warren B. Kice

[57] ABSTRACT

A closure assembly for a furnace wall in which a plug member is secured to a door shell which, in turn, is pivotally mounted to the furnace wall. A plurality of anchor members are secured to the shell and extend through openings in and are secured relative to the plug member.

2 Claims, 1 Drawing Sheet

CLOSURE ASSEMBLY FOR A FURNACE

BACKGROUND OF THE INVENTION

Insulated access doors for furnace walls are typically fabricated from concrete poured over a wire screen attached to the door structure and then cured. Alternatively, a plurality of laminated fire bricks are attached by complex lug arrangements to the door structure. Both of these arrangements are expensive and their installation is time-consuming, requiring the services of at least two mechanics over a period of days to complete the final installation.

In addition to the foregoing problems, these type of doors are difficult to repair and a boiler shut-down may be required when a door is removed for any length of time. Also, the doors presently in use are somewhat brittle and are damaged quite easily if not handled with extreme care, thus adding to the difficulties.

In an effort to overcome these defects, more recent insulated furnace doors utilize a plurality of cast ceramic materials. However, these materials have to be cast in place and then cured, which is time consuming. In addition, the use of multiple materials create inherent shear planes which lead to cracking and failure of the insulation.

Another problem associated with prior art doors of this type is that they have a relatively high thermoconductivity and thus often require the installation of an additional protective shield at the face of the door to accommodate excess temperatures encountered in the furnace. Of course, the installation and materials cost involved in such type of shields further adds to the expense involved.

SUMMARY OF THE INVENTION

It is therefore an object of the present invention to provide a closure assembly for a furnace which can be fabricated, installed in place, and repaired in a relatively simple and fast manner and at a relatively low cost.

It is a still further object of the present invention to provide a closure assembly of the above type which has a relative low thermoconductivity and eliminates the need for the above-mentioned protective shield.

It is a more specific object of the present invention to provide a closure assembly of the above type which includes a single cast ceramic material which can be installed to a door shell in a simple, quick, and efficient manner.

Toward the fulfillment of these and other objects, the closure assembly of the present invention comprises a shell member, a plug member of a ceramic material engaging the inner wall of the shell member, and a plurality of anchor members fixed to the door shell, extending through the plug member and attached to a metal cup which is secured in the plug member.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawing wherein.

DESCRIPTION OF THE PREFERRED EMBODIMENT

Figure 1:
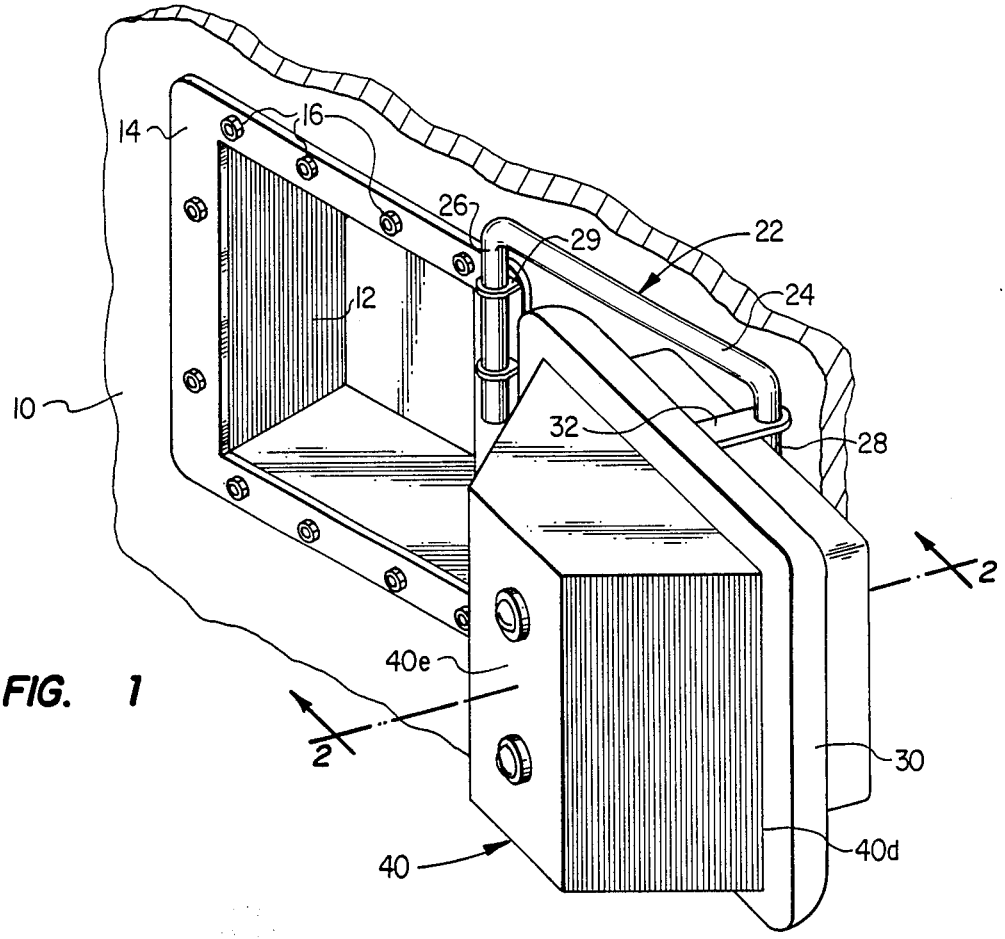
FIG. 1 is a front elevational view depicting the closure assembly of the present invention shown in an open position relative to the access opening of a furnace wall.
Figure 2:
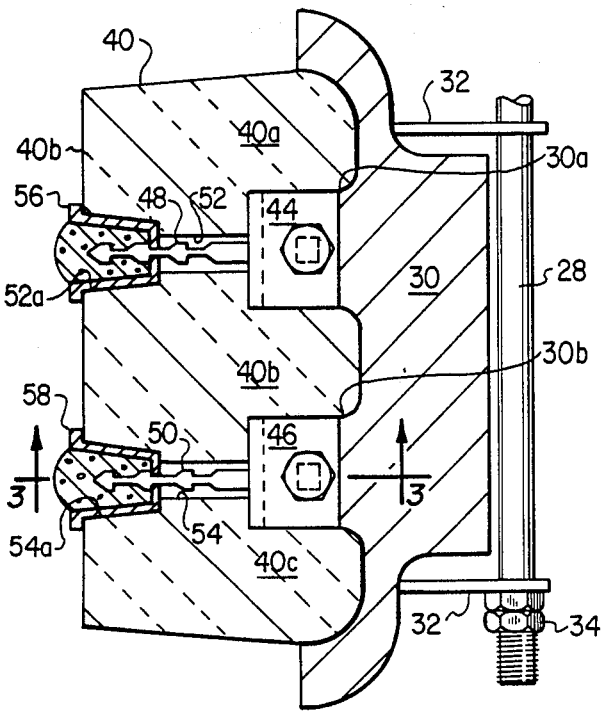
FIG. 2 is a vertical, cross-sectional view taken along the line 2—2 of FIG. 1.

Referring specifically to FIGS. 1 and 2, the reference numeral 10 refers in general to the front wall of a furnace enclosure which is formed with an access opening 12. Although not clear from the drawings, it is understood that the wall 10 can be formed in any known manner and can include water tubes, a refractory material, and other components normally utilized in conventional walls of this type.

A rectangular faceplate 14 is attached to the outer surface of the furnace wall 10 and surrounds the access opening 12, with the faceplate 14 defining an opening which substantially corresponds in size to the opening 12. The faceplate 14 is fastened relative to the wall 10 by a plurality of bolts 16 which extend through the wall and the faceplate and which receive a plurality of nuts (not shown).

A divot hinge assembly is provided which includes a bar 22 bent in two planes to form a base portion 24, a relatively short leg portion 26, and a relatively long leg portion 28. The leg portion 26 is rotably mounted in a bracket 29 affixed to one side of the faceplate 14 to permit pivotal movement of the bar 22 relative to the faceplate.

A door shell member 30 is provided which has a pair of brackets 32 mounted on its rear face which receive the relatively long leg portion 28 of the bar 22 to permit pivotal movement of the shell member 30 relative to the bar. The free end portion of the leg portion 28 is threaded and accommodates a nut 34 for maintaining the shell member 30 on the leg portion 28.

A plug member 40 is secured to the front, or inner, face of the shell member 30 with three protrusions **40*c*, 40*b*, 40*c* formed in the base of the plug member extending in corresponding cavities found in the inner face of the shell member. The plug member 40 is preferably formed of a ceramic material of a type to be described in detail later, and has a base portion 40*d* (FIG. 1) of rectangular shape corresponding to that of the shell member 30 but having a length and width slightly less than that of the shell member. The width of the plug member 40 decreases from the base portion 40*d* to its front face portion 40*e*** to form a tapered cross-section.

Figure 3:
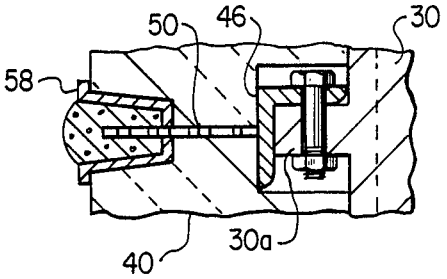
FIG. 3 is a cross-sectional view taken along the line 3—3 of FIG. 2.

As shown in FIGS. 2 and 3, the inner face of the shell member 30 is scalloped and includes two interior flanges or shoulder portions **30*a* and 30*b* which receive a clip angles 44 and 46, respectively. A pair of notched anchor members 48 and 50 are secured in any convention manner, such as by welding, to the outer face of the one of the leg portions of the clip angles 44 and 46**, respectively.

Two bores 52 and 54 are formed through the plug member 40 and are countersunk at **52*a* and 54*a*, respectively, to form two enlarged openings whose ends extend flush with the outer face 40*b* of the plug member. A pair of ceramic cup members 56 and 58 are disposed in the counterbores 52*a* and 54*a*, respectively, and have annular lip portions that extend over in engagement with the outer surface 40*b* of the plug member. A slot is formed in the base of each cup member 56 and 58** for reasons to be described.

As shown in FIG. 3, a leg portion of the L-shaped clip angle 46 extends over a corresponding face of the shoulder 30*a* of the door shell 30, and has an opening therethrough which receives a bolt 60 which, in turn, receives a nut 62 for securing the clip angle 46 relative to the shoulder 30*a*. It is understood that the clip angle 44 is fastened to the shoulder 30*b* in an identical manner.

In assembly, the clip angles 44 and 46 are bolted to the shoulders 30*a* and 30*b* respectively as described above with the anchors 48 and 50 thus extending substantially perpendicular to the plane of the door shell 30. The plug member 40 is then placed over and into the door shell 30 with the anchor members 48 and 50 extending through the bores 52 and 54 and the counterbores 52*a* and 54*a*, respectively, and through slots formed in the base portions of the cup members 56 and 58, respectively.

The cup members 56 and 58 are then rotated ninety degrees so that the slots in their base portion extend in the corresponding notches formed in the anchors 48 and 50 to secure the anchors relative to the cup members and therefore to the clip angles 44 and 46. A ceramic material, shown in general by the reference numerals 64 and 66, is then cast into the interior of the cups 56 and 58, respectively, and over the exposed portion of the anchors 48 and 50, respectively, to further secure the plug member 40 relative to the shell 30.

It is understood that a pair of spring type handles (not shown) are provided on the outer, or rear, face of the shell member 30 to facilitate the opening and closing of the shell member relative to the access opening 12, and that a locking mechanism can be provided to secure the closure assembly of the present invention over the opening 12.

The plug member 40 is preferably constructed of a cast block formed from a tamping mix of bulk fibers and high temperature inorganic binders. The particular material most preferred because of its lightweight properties and high temperature insulating capabilities is manufactured by the Carborundum Company and has a product number of FC-25. In this configuration, the plug member would have a density of approximately 18 pounds per square foot which, of course, renders the closure assembly of the present invention extremely light when compared to the prior art assemblies discussed above. The shell member 30 can be fabricated of cast iron or forged steel in a conventional manner, and the cups 56 of a metallic material.

Several advantages result from the arrangement of the present invention. For example, the plug member 40 is relatively light in weight and therefore can be easily handled during installation, repair or replacement. Also, the cast ceramic material used to fabricate the plug member 40 has a relatively low thermoconductivity and thus is capable of establishing an acceptable rigid temperature differential of over 2000° F. without the necessity of installing an additional fire brick protective shield or the like at the outer face of the access opening 12. Also, the depth of the plug member from its front face to its rear face may be as little as six inches yet still accomplish this high temperature insulation. Further the plug member 40 is cast from only one ceramic material and thus is not susceptible to shear planes as would be the case if multiple materials were used.

It is understood that several variations may be made in the foregoing without departing from the scope of the invention. For example, the number of anchor connections between the plug member and the door shell can be increased from the two disclosed in the above embodiment especially when an access door is involved rather than an observation door.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the scope of the invention therein.

What is claimed is:

1. A closure assembly for an access opening in a furnace wall, said assembly comprising a door shell; means for pivoting said door shell to said furnace wall; at least one shoulder formed on said shell; a clip angle having one leg portion extending over a face of said shoulder; bolt means extending through said one leg portion and said shoulder for securing said clip angle to said shoulder; an anchor member secured to another leg portion of said clip angle; a plug member having a portion extending in said shell, a recessed portion for receiving said shoulder, and a portion adapted to extend in said access opening when said door is closed; at least one opening extending through said plug member for receiving said anchor member; a cup extending in said opening and adapted to receive a corresponding anchor member; and a castable material extending in said cup and over said anchor member to secure said plug member to said shell.

2. The assembly of claim 1 wherein the base of said cup is provided with a slot through said anchor member extends.

* * * * *